US006426691B1

(12) United States Patent
Kido

(10) Patent No.: US 6,426,691 B1
(45) Date of Patent: Jul. 30, 2002

(54) RADIO SELECTIVE CALLING RECEIVER AND RECEIPT FREQUENCY SEARCH CONTROL METHOD THEREFOR

(75) Inventor: Toru Kido, Shizuoka (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/427,741

(22) Filed: Oct. 27, 1999

(30) Foreign Application Priority Data

Oct. 28, 1998 (JP) ..... 10-307204

(51) Int. Cl.[7] ..... G08B 5/22

(52) U.S. Cl. ..... 340/7.2; 340/7.39; 340/7.52; 340/825.69

(58) Field of Search ..... 340/7.2, 7.39, 340/7.52, 10.4, 825.69, 825.72

(56) References Cited

FOREIGN PATENT DOCUMENTS

| | | |
|---|---|---|
| JP | 6-244777 | 9/1994 |
| JP | 7-122975 | 5/1995 |

*Primary Examiner*—Daryl Pope
(74) *Attorney, Agent, or Firm*—Sughrue Mion, PLLC

(57) ABSTRACT

A radio selective calling receiver includes a storage 105 storing a plurality of frequencies each corresponding to a particular area in which a service is available. A synchronized frequency storage 112 stores, frequency by frequency, the numbers of times of synchronization set up at consecutive sampling times together with the sampling times. When frequency search begins, a receipt frequency control 110 sequentially searches the frequencies in accordance with the number of times of synchronization set up at a sampling time closest to the time at which the search has begun. The receiver is capable reducing a period of time necessary for a frequency search without forcing the user of the receiver to perform any special setting operation. This reduces the probability of missing a call meant for the receiver and saves power to be allocated to frequency search.

6 Claims, 6 Drawing Sheets

| TIME / FREQUENCY | 00:00 | ~ | 08:00 | 09:00 | 10:00 | 11:00 | 12:00 | 13:00 | 14:00 | ~ | 23:00 |
|---|---|---|---|---|---|---|---|---|---|---|---|
| F1 | 9 | | 8 | 7 | 2 | 0 | 0 | 0 | 0 | | 9 |
| F2 | 0 | | 0 | 0 | 0 | 1 | 5 | 2 | 3 | | 0 |
| F3 | 0 | | 0 | 2 | 7 | 8 | 3 | 7 | 3 | | 0 |
| F4 | 0 | | 1 | 0 | 0 | 0 | 1 | 0 | 1 | | 0 |
| F5 | 1 | | 1 | 1 | 1 | 1 | 1 | 1 | 3 | | 1 |
| F6 | 0 | | 0 | 0 | 0 | 0 | 0 | 0 | 0 | | 0 |

FIG.2

RADIO SELECTIVE CALLING RECEIVER AND RECEIPT FREQUENCY SEARCH CONTROL METHOD THEREFOR

BACKGROUND OF THE INVENTION

1. Field of the Invention

The present invention relates to a pager or similar radio selective calling receiver and more particularly to a receipt frequency search control method for a radio selective calling receiver.

2. Description of the Related Art

It has been customary with a radio selective calling receiver to receive a signal having a single particular frequency and, if the signal includes an ID (identification) number assigned to the receiver, alerts the user of the receiver to the receipt of a message while displaying the message. The problem with this kind of conventional receiver is that the receiver cannot receive a service in areas different in frequency from a single area assigned to the receiver.

A multiarea service allowing a radio selective calling receiver to receive a service over a plurality of areas is an implementation recently proposed to solve the above problem. A radio selective calling receiver authorized to receive a multiarea service is required to search for one of a plurality of frequencies allocated to the current area, and then receive a signal having the frequency searched for. For this purpose, the receiver sequentially searches the frequencies registered thereat and thereby detects a signal which it can received in the current area.

However, the conventional receiver to receive the multiarea service has some problems left unsolved, as follows. A period of time necessary for the receiver to search all of the registered frequencies once increases in proportion to the number of registered frequencies. It follows that as the number of registered frequencies increases, the time when the receiver detects a synchronizing signal is delayed in areas servicing at frequencies to be searched at a late stage of search, delaying the time of synchronization. The receiver is therefore apt to miss a call meant for the pager. In addition, power consumption is aggravated with an increase in search time.

In light of the above, Japanese patent laid-open publication No. 7-122975 proposes a radio selective calling receiver capable of promoting efficient search and reducing a search time. Specifically, the receiver taught in this document registers frequencies not needing search at a skip memory as skip frequencies, and does not search the skip frequencies at the time of search. This kind of scheme, however, requires the user of the receiver to register the skip frequencies at the skip memory beforehand by troublesome operation.

Further, Japanese patent laid-open publication No. 6-244777 discloses a radio selective calling receiver constructed to sense field strengths during the first search cycle and then rearrange a searching order for the second search cycle on the basis of the sensed field strengths, thereby promoting efficient frequency searching. However, this procedure is effective only for the second and successive search cycles following the first search cycle failed to determine a receipt frequency. Further, conditions may differ from the first search cycle to the second and successive search cycles. In addition, the first search cycle and the second and successive search cycles must always be effected in combination, limiting efficiency available with the receiver.

SUMMARY OF THE INVENTION

It is therefore an object of the present invention to provide a radio selective calling receiver capable of efficiently searching a plurality of frequencies without resorting to any extra operation, e.g., registration of frequencies, and a frequency search control method therefor.

In accordance with the present invention, a radio selective calling receiver includes a memory storing a plurality of frequencies each corresponding to a particular area in which a service is available. A receipt frequency control section sequentially searches the frequencies stored in the memory to thereby determine a frequency capable of being received in the current area. A timepiece counts time. A synchronized frequency storage stores, for each of the frequencies, the number of times of synchronization set up at each preselected sampling time together with the sampling time. When frequency search begins, the receipt frequency control section sequentially searches the frequencies in order of the number of times of synchronization set up at a sampling time closest to a frequency search start time at which the frequency search has begun, the frequency having the greatest number of times being first.

In a preferred embodiment, the receipt frequency control section determines, when frequency search begins, a first and a second sampling time closest and second closest to a frequency search start time when the frequency search has begun, weights the numbers of times of synchronization respectively set up at the first and second sampling times by weights inversely proportional to a difference between the search start time and the first sampling time and a difference between the search start time and the second sampling time, respectively, produces a sum of the weighted numbers of times, and sequentially searches the frequencies in order of the size of the sum, the frequency having the greatest sum being first.

In another preferred embodiment, the receipt frequency control section determines, when frequency search begins, a first and a second sampling time closest and second closest to a frequency search start time when the frequency search has begun, produces a sum of the numbers of times of synchronization respectively set up at the first and second sampling times, and sequentially searches the frequencies in order of the size of the sum, the frequency having the greatest sum being first.

BRIEF DESCRIPTION OF THE DRAWINGS

The above and other objects, features and advantages of the present invention will become more apparent from the following detailed description taken with the accompanying drawings in which:

FIG. 2 is a table showing specific contents of a synchronized frequency storage included in the illustrative embodiment;

DESCRIPTION OF THE PREFERRED EMBODIMENTS

Figure 1:
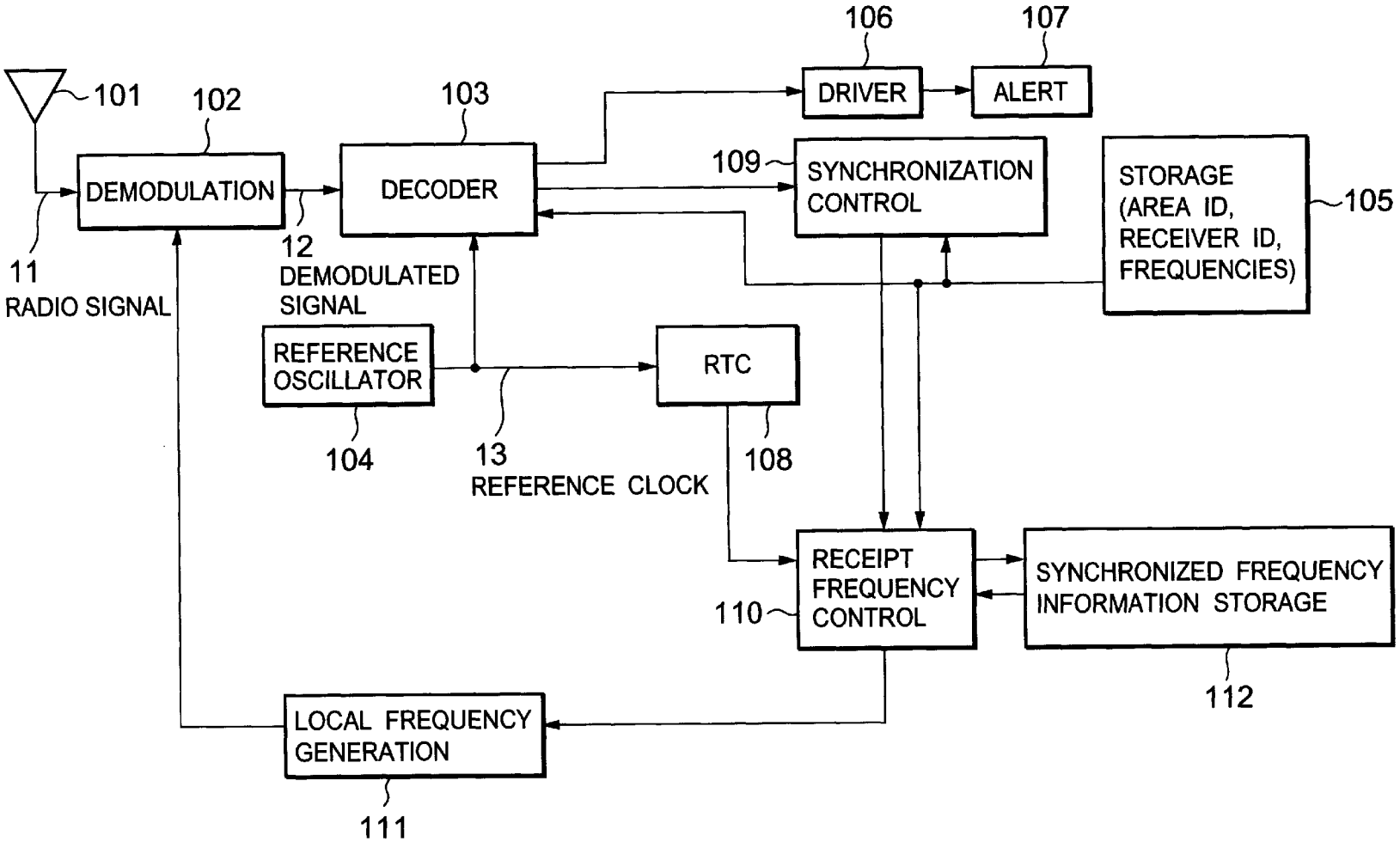
FIG. 1 is a block diagram schematically showing a radio selective calling receiver embodying the present invention.

Referring to FIG. 1 of the drawings, a radio selective calling receiver embodying the present invention is shown.

As shown, the radio selective calling receiver (receiver hereinafter) is generally made up of an antenna 101, a demodulation 102, a decoder 103, a reference oscillator 104, a storage 105, a driver 106, an alert 107, a real-time clock counting (RTC) 108, a synchronization control 109, a receipt frequency control 110, a local frequency oscillation 111, and a synchronized frequency information storage 112.

The demodulation 102 amplifies a radio signal 11 coming in through the antenna 101, demodulates the amplified signal, and feeds its output to the decoder 103 as a demodulated signal 12.

The reference oscillator 104 outputs a reference clock 13 and also feeds it to the decoder 103. The decoder 103 produces a recovery clock for sampling data on the basis of the demodulated signal 12 and reference clock 13 and decodes the demodulated signal 12 with the recovery clock. Further, after synchronization, the decoder 103 compares an ID number included in the demodulated data and an ID number stored in the storage 105. If the two ID numbers compare equal, the decoder 103 separates message data also included in the demodulated data and controls the driver 106 to inform the alert 107 of the receipt of a message meant for the receiver.

It is to be noted that the word "synchronization" mentioned above refers to a condition wherein the receiver acquires a receipt frequency and is ready to receive a calling signal meant for the receiver.

The storage 105 is implemented by an EEPROM (Electrically Erasable and Programmable Read Only Memory) or similar rewritable nonvolatile memory. The storage 105 stores the ID number assigned to the receiver, area identification information for distinguishing areas, and a plurality of frequencies to be searched.

The alert 107 includes an LCD (Liquid Crystal Display), a speaker, an LED (Light Emitting Diode) and so forth and is driven by the driver 106.

The RTC 108 counts at least hours and minutes on the basis of the reference clock 13 output from the reference oscillator 104.

The synchronization control 109 compares the area identification information stored in the storage 105 and area identification information demodulated by the decoder 103. If the two different information compare equal, the synchronization control 109 determines that the receiver is located in an adequate area, and informs the receipt frequency control 110 of the establishment of synchronization. If the above information are not coincident, the synchronization control 109 holds a frequency searching state.

Why the frequency control 109 allows the receiver to receive a call only if the received area identification information is coincident with the stored area identification information is as follows. Generally, not all areas use different frequencies, but some areas remote from each other sometimes use the same frequency for the efficient use of limited frequencies. The frequency control 109 therefore protects the receiver from malfunction when the user of the receiver moves into an area where the user is not expected to receive a service.

The receipt frequency control 110 selects one frequency to be searched for out of a plurality of frequencies registered at the storage 105 and sets it in the local frequency generation 111. In response, the local frequency generation 111 generates a local oscillation signal and feeds it to the demodulation 102. The local oscillation signal causes the demodulation 102 to demodulate a signal having the frequency selected by the control 110.

The synchronized frequency storage 112 stores time information output from the RTC 108 and information representative of frequencies set up synchronization at each of the times indicated by the time information. FIG. 2 shows specific contents stored in the synchronized frequency storage 112. As shown, frequencies F1 through Fn (n being 2 or greater integer) are registered at the receiver although only six frequencies F1 through F6 are shown specifically. The RTC 108 counts times from 00:00 to 23:00. Numerals listed in FIG. 2 each show how many times the associated frequency has set up synchronization at each of the times 00:00 through 23:00 in terms of a cumulative value as counted from the start of counting. For example, at the time 00:00, synchronization has been set up nine times at the frequency F1 and once at the frequency F5 after the start of counting, but not set up at the other frequencies at all. The receipt frequency control 110 writes such data in the storage 112 in synchronism with the timing of the RTC 108.

Figure 3:
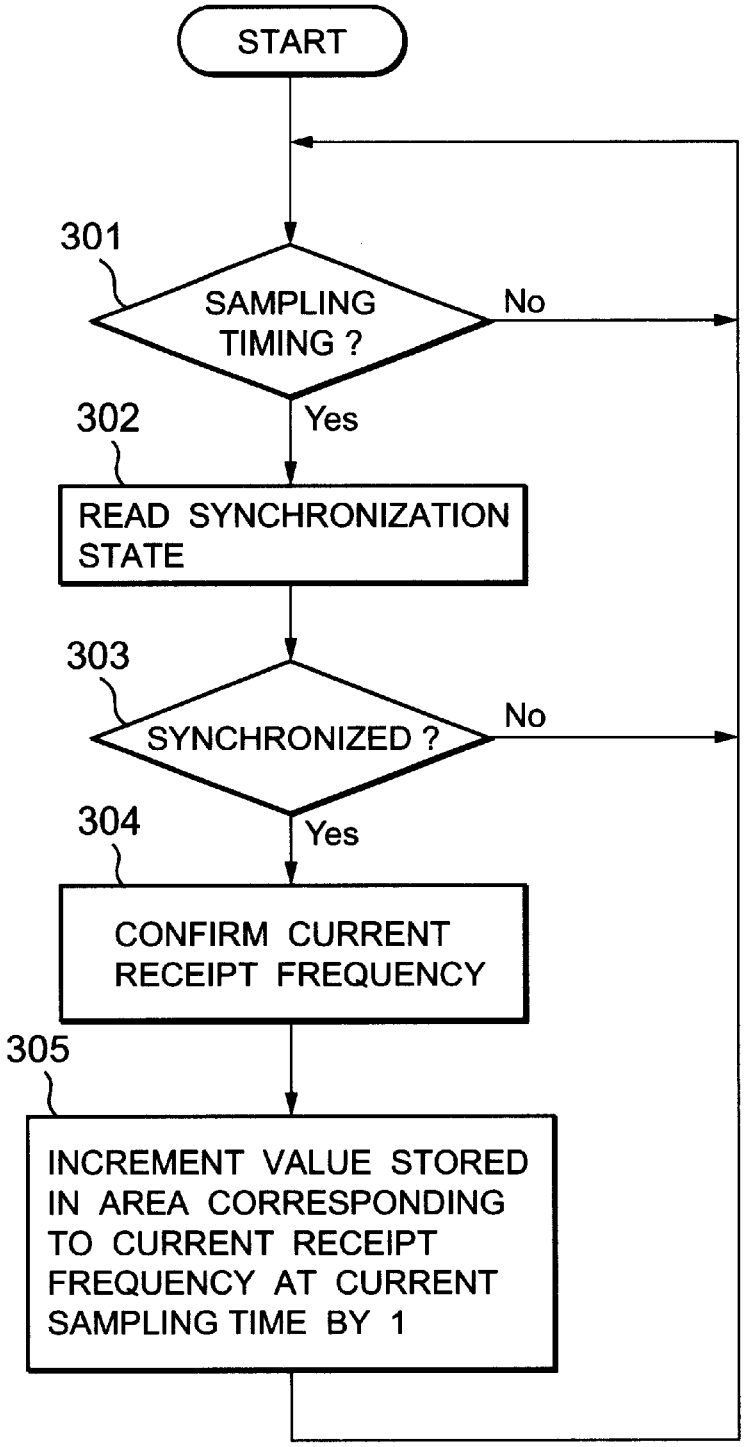
FIG. 3 is a flowchart demonstrating a specific writing operation of a receipt frequency control also included in the illustrative embodiment.
Figure 4:
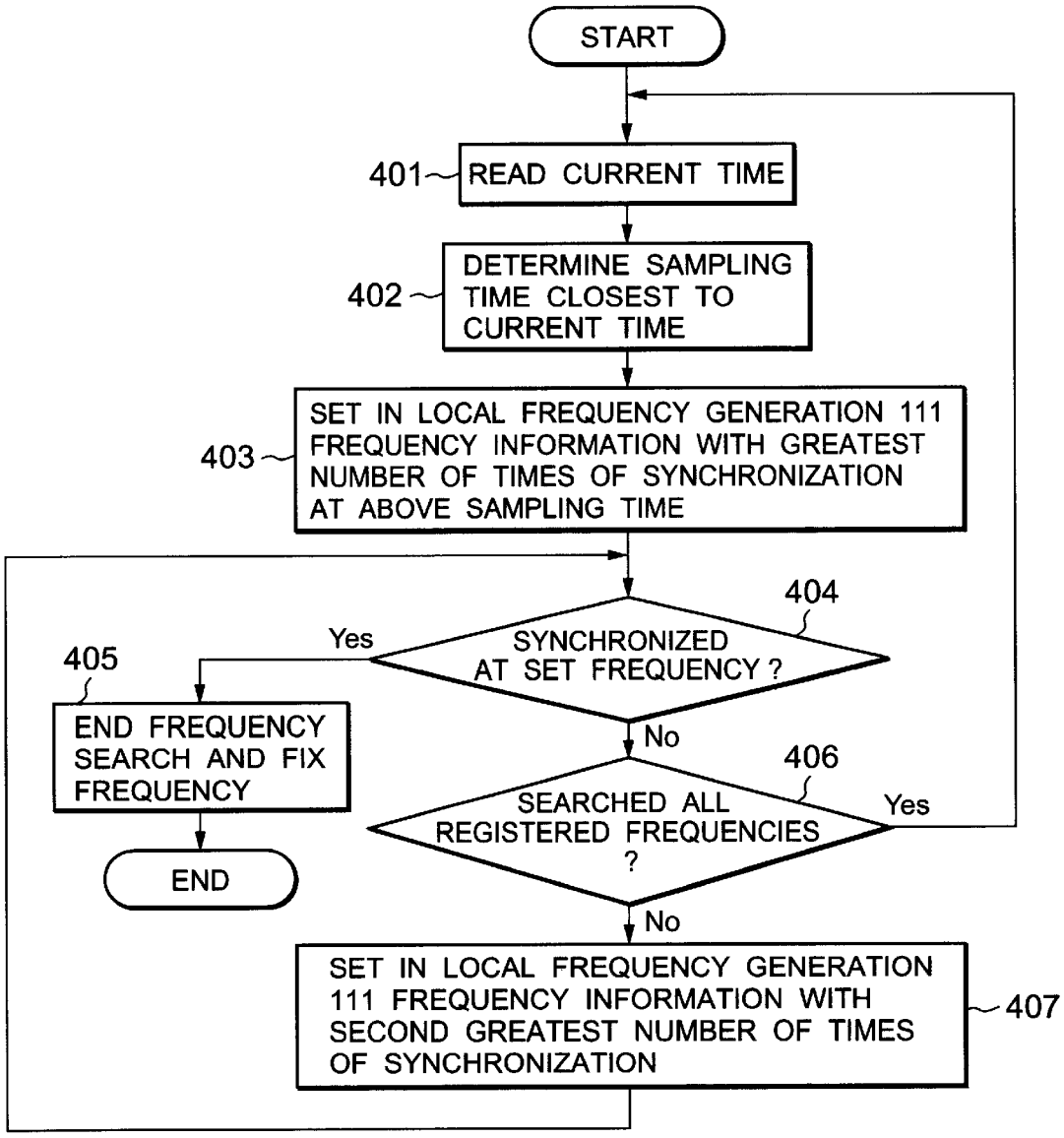
FIG. 4 is a flowchart representative of a specific searching operation of the receipt frequency control.

Reference will be made to FIGS. 3 and 4 for describing a specific operation of the illustrative embodiment. FIG. 3 shows part of the operation relating to the writing of data executed by the receipt frequency control 110. As shown, after the power-on of the pager, the control 110 monitors the RTC 108 and waits until a preselected sampling time (step 301). In the illustrative embodiment, the sampling time is selected to be zero minute every hour. At the sampling time (Yes, step 301), the control 110 reads a synchronization state out of the synchronization control 109 (step 302). If the synchronization state shows that synchronization is set up (Yes, step 303), the control 110 confirms a frequency currently set in the local frequency generation 111 (step 304). Subsequently, the control 110 increments by 1 (one) a value stored at a position corresponding to the above sampling time 00:00 and the above confirmed frequency (see FIG. 2). If the answer of the step 303 is negative (No), the control 110 waits until the next sampling time.

FIG. 4 demonstrates the other part of the specific operation relating to searching also executed by the receipt frequency control 110. When the user of the receiver turns on power supply, the control 110 starts searching frequencies. Specifically, as shown in FIG. 4, the control 110 reads the current time out of the RTC 108 as a frequency search start time (step 401). Then, the control 110 selects one sampling time closest to the current time out of the sampling times stored in the synchronized frequency information storage 112 (step 401). For example, if the current time is 08:40 a.m., the control 110 selects a sampling time 09:00 a.m. shown in FIG. 2.

Subsequently, the control 110 reads the numbers of times of synchronization set up at the above particular sampling time out of the synchronized frequency information storage 112 and sets frequency information corresponding to the greatest number of times in the local frequency generation 111 (step 403). In the specific table shown in FIG. 2, the control 110 sets information representative of the frequency F1 in the local frequency oscillation 111. If two or more frequencies correspond to the greatest number of times of synchronization, the control 110 may sequentially set such frequencies in the order in which they are registered at the storage 105.

Assume that the synchronization control 109 determines that the received area identification information is identical with the area identification information stored in the storage 105, and that synchronization is set up (Yes, step 404). Then, the control 110 fixes the current frequency and ends the frequency search, determining that synchronization is set up (step 405). If the synchronization control 109 does not report synchronization to the control 110 (No, step 404) and if the control 110 has not searched all of the frequencies yet (No, step 406), the control 110 searches for the next candidate frequency (step 407).

Specifically, in the step 407, the control 110 reads the information stored in the synchronized frequency information storage 112 and sets in the local frequency generation 111 the frequency having the second greatest number of times of synchronization at the above sampling time (frequency F3 in FIG. 2). If this frequency also fails to set up synchronization as a result of frequency search, the control 110 sets in the local frequency generation 111 the frequency having the third greatest number of times of synchronization at the same sampling time.

As stated above, the control 110 sequentially searches the frequencies stored at the sampling time closest to the frequency search start time, the frequency having the greatest number of times of synchronization being first. If synchronization is not set up even when the search completes with all of the n registered frequencies (Yes, step 406), the control 110 again obtains the current time and repeats the step 401 and successive steps.

It will be seen from the above that the illustrative embodiment stores time data and frequency data representative of frequencies set up synchronization at each time represented by the time data. At the beginning of frequency search in an adequate service area, the illustrative embodiment first finds a frequency most probable to set up synchronization at the time when the search has begun. This is successful to set up synchronization at the early stage of frequency search, i.e., reduces a period of time necessary for frequency search without forcing the user of the pager to perform any special setting operation. Rapid synchronization not only promotes easy and convenient operation of the pager, but also reduces the probability of missing a call meant for the pager. Moreover, with rapid synchronization, it is possible to save power to be allocated to frequency search.

To describe the above embodiment more specifically, assume that service areas each are assigned to a particular municipality. For example, for a person residing in Kanagawa Prefecture, but working in Tokyo Metropolis adjoining Kanagawa Prefecture, synchronization is expected to occur most frequency at the frequency assigned to the area covering Tokyo over a time zone between 9:00 and 20:00, but at the frequency assigned to the area covering Kanagawa over the other time zone. In this specific case, the receiver of the illustrative embodiment first receives the frequency of the area covering Tokyo between 9:00 and 20:00 and then receives, if the frequency fails to set up synchronization, the frequency of the area covering Kanagawa. In the time zone other than the time zone between 9:00 and 20:00, the pager first receives the frequency of the area covering Kanagawa and then receives, if the frequency fails to set up synchronization, the frequency of the area covering Tokyo. The pager therefore minimizes the search time and thereby realizes rapid synchronization while sparingly missing calls meant for the pager.

Figure 5:
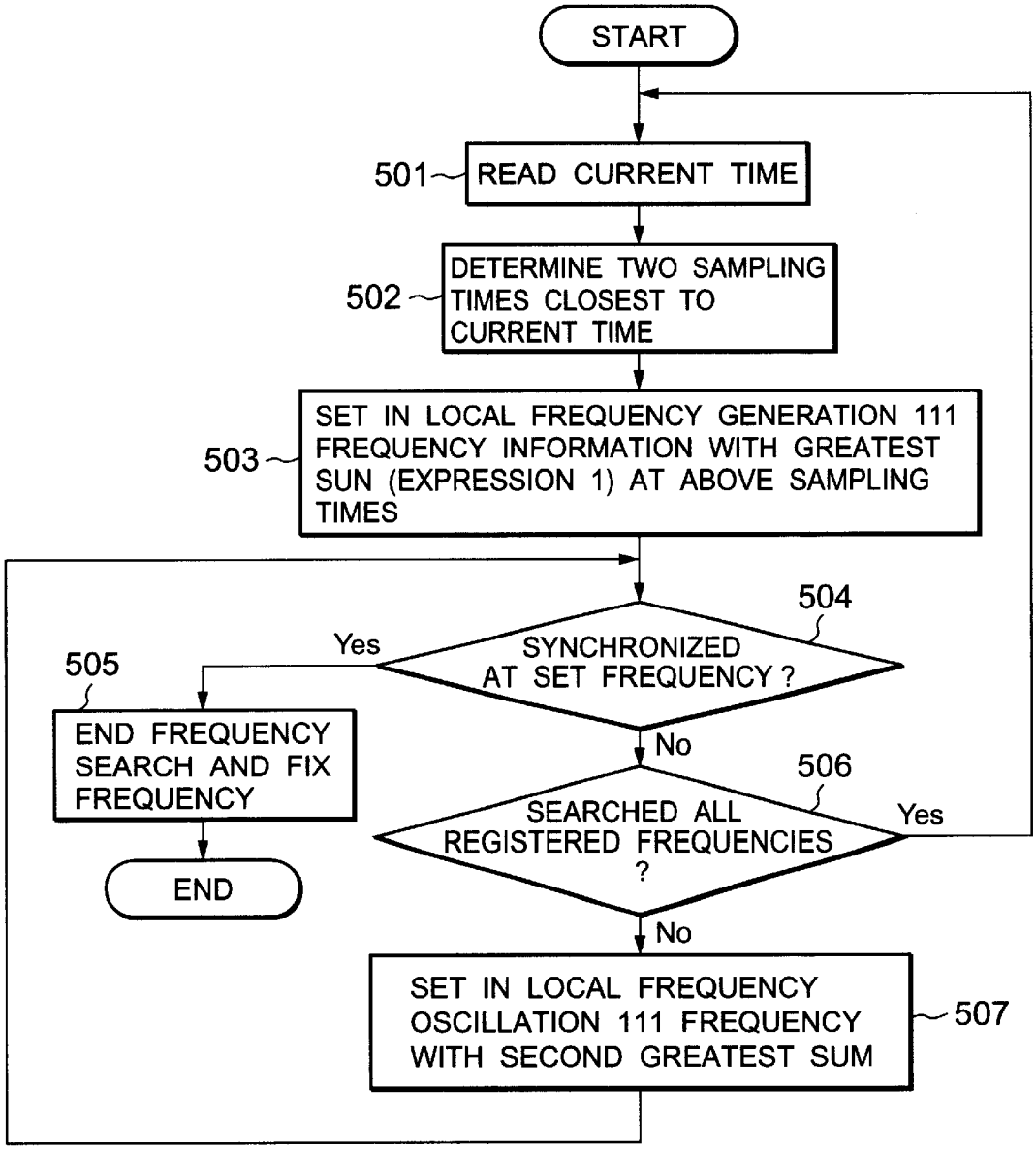
FIG. 5 is a flowchart showing a specific searching operation representative of an alternative embodiment of the present invention.

Reference will be made to FIG. 5 for describing an alternative embodiment of the present invention which is also practicable with the basic configuration shown in FIG. 1. In the previous embodiment, the receipt frequency control 110 first searches for a frequency having the greatest number of times of synchronization at a sampling time closest to a frequency search start time. In the alternative embodiment to be described, the receipt frequency control 110 pays attention not only to the number of times of synchronization set up at a sampling time closest to a frequency search start time but also the number of times synchronization set up at a sampling time second closest to the same. The numbers of times of synchronization set up at the above sampling times each are given a particular weight inversely proportional to a difference between the frequency search start time and the sampling time. The weighted numbers of times are added to produce a sum. The control 110 first searches for a frequency having the greatest sum.

In this embodiment, while the synchronized frequency information storage 112 has the same contents as in the previous embodiment, the receipt frequency control 110 provides the frequencies to search with an order different from the order of the previous embodiment. Specifically, in steps corresponding to the steps 403 and 407 of the previous embodiment, this embodiment uses the following expression:

$$(ts-t2\times D1n)+(ts-t1\times D2n) \quad (1)$$

where ts denotes a frequency search start time, t1 denotes a sampling time closest to the time ts, t2 denotes a sampling time second closest to the time ts, and D1n and D2n respectively denote the numbers of times of synchronization set up at the sampling times t1 and t2 at a given frequency Fn.

As shown in FIG. 5, the control 110 reads the current time or frequency search start time ts (step 501) and then determines two sampling times t1 and t2 closest and second closest to the time ts (step 502). The control 110 weights the numbers of times of synchronization D1n and D2n at the times t1 and t2 by differences Its–t2I and Its–t1I and then produces a sum of the weighted values (step 503). Thereafter, the control 110 sequentially searches the frequencies in accordance with the size of the sum, the frequency having the greatest sum being first (steps 504–507).

Although the alternative embodiment deals with the same amount of sampled data as the previous embodiment, the former is capable of setting up a more accurate frequency searching order than the latter on the basis of a relation between the time and the frequency set up synchronization.

Figure 6:
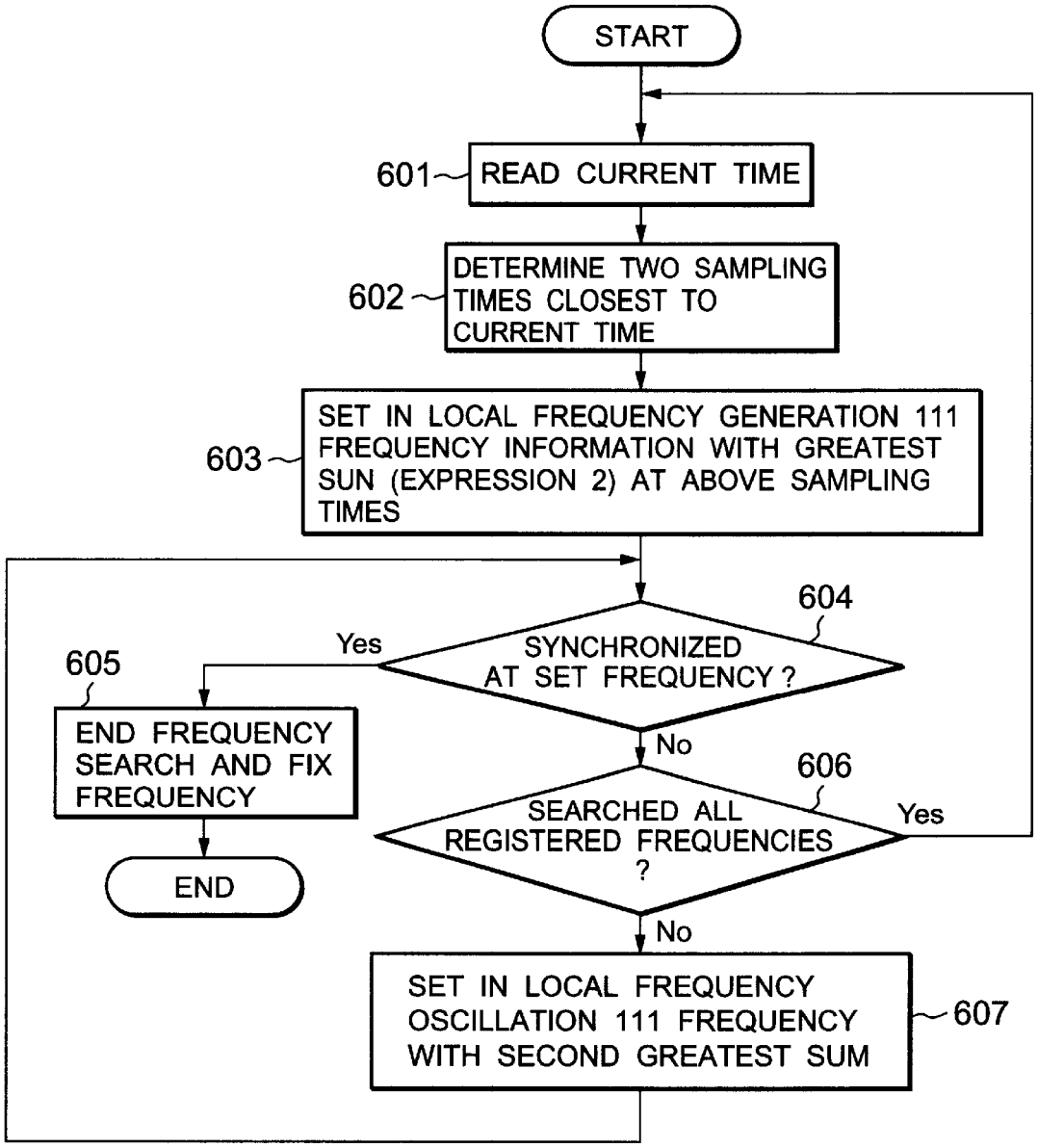
FIG. 6 is a flowchart showing a specific searching operation representative of another alternative embodiment of the present invention.

FIG. 6 shows another alternative embodiment of the present invention. This embodiment is identical with the embodiment of FIG. 5 up to the step of determining two sampling times closest and second closest to a frequency search start time. The difference is that this embodiment determines a frequency searching order by using the following expression:

$$D1n+D2n \quad (2)$$

That is, the illustrative embodiment simply adds the number of times of synchronization D1n and D2n at the two sampling times. The receipt frequency control 110 therefore sequentially searches the frequencies in accordance with the size of the resulting sum. In FIG. 6, steps 601–607 respectively correspond to the steps 501–507 of FIG. 5. The step 603 uses the above expression (2) in place of the expression 1 of the step 503.

Although this embodiment is slightly inferior to the embodiment of FIG. 5 in accuracy based on a relation between the time and the receipt frequency, the former is practicable with a smaller number of calculation steps than the latter. In addition, this embodiment can determine a more accurate scanning order than the embodiment described first.

It is to be noted that the embodiments of FIGS. 5 and 6 each may, of course, select three or more sampling times in the expression (1) or (2). It is not necessary for the embodiments shown and described to use the sampling times having the same intervals (intervals of 1 hour in FIG. 2). For example, to reduce a capacity required of the synchronized frequency information storage 112, the midnight time zone in which a pager is usually moved little may not be sampled at all.

It should be noted that the radio selective calling receiver to which the present invention pertains refers not only to a pager but also to a handy phone, handy radio terminal or similar handy radio equipment.

In summary, it will be seen that the present invention provides a radio selective calling receiver and a receipt frequency search control method therefor capable of setting up synchronization at the early stage of frequency search, i.e., reducing a period of time necessary for frequency search without forcing the user of the receiver to perform any special setting operation. This reduces the probability of missing a call meant for the receiver and saves power to be allocated to frequency search.

While the invention has been described with reference to specific embodiments thereof, it will be appreciated by those skilled in the art that numerous variations, modifications and embodiments are possible, and accordingly all such variations, modifications and embodiments are to be regarded as being within the spirit and scope of the invention.

What is claimed is:

1. A radio selective calling receiver comprising:

a memory storing a plurality of frequencies each corresponding to a particular area in which a service is available;

receipt frequency control means for sequentially searching the plurality of frequencies stored in said memory to thereby determine a frequency capable of being received in a current area;

timepiece means for counting time; and synchronized frequency storing means for storing, for each of the plurality of frequencies, a number of times of synchronization set up at each preselected sampling time together with said sampling time;

said receipt frequency control means sequentially searching, when a frequency search begins, the plurality of frequencies in an order of a number of times of synchronization set up at a sampling time closest to a frequency search start time at which said frequency search has begun, the frequency having the greatest number of times being first.

2. A radio selective calling receiver comprising:

a memory storing a plurality of frequencies each corresponding to a particular area in which a service is available;

receipt frequency control means for sequentially searching the plurality of frequencies stored in said memory to thereby find a frequency capable of being received in a current area;

timepiece means for counting time; and synchronized frequency storing means for storing, for each of the plurality of frequencies, a number of times of synchronization set up at each preselected sampling time together with said sampling time;

said receipt frequency control means determining, when a frequency search begins, a first and a second sampling time closest and second closest to a frequency search start time when said frequency search has begun, weighting numbers of times of synchronization respectively set up at said first sampling time and said second sampling time by weights inversely proportional to a difference between said search start time and said first sampling time and a difference between said search start time and said second sampling time, respectively, producing a sum of weighted numbers of times, and sequentially searching the plurality of frequencies in an order of a size of said sum, the frequency having the greatest sum being first.

3. A radio selective calling receiver comprising:

a memory storing a plurality of frequencies each corresponding to a particular area in which a service is available;

receipt frequency control means for sequentially searching the plurality of frequencies stored in said memory to thereby find a frequency capable of being received in a current area;

timepiece means for counting time; and synchronized frequency storing means for storing, for each of the plurality of frequencies, a number of times of synchronization set up at each preselected sampling time together with said sampling time;

said receipt frequency control means determining, when a frequency search begins, a first and a second sampling time closest and second closest to a frequency search start time when said frequency search has begun, producing a sum of numbers of times of synchronization respectively set up at said first sampling time and said second sampling time, and sequentially searching the plurality of frequencies in an order of a size of said sum, the frequency having the greatest sum being first.

4. A receipt frequency search control method for a radio selective calling receiver storing a plurality of frequencies each corresponding to a particular area in which a service is available, and sequentially searching said plurality of frequencies to thereby determine a frequency capable of being received in a current area, said method comprising the steps of:

storing, for each of the plurality of frequencies, a number of times of synchronization set up at each preselected sampling time together with said sampling time; and sequentially searching, when a frequency search begins, the plurality of frequencies in an order of a number of times of synchronization set up at a sampling time closest to a frequency search start time at which said frequency search has begun, the frequency having the greatest number of times being first.

5. A receipt frequency search control method for a radio selective calling receiver storing a plurality of frequencies each corresponding to a particular area in which a service is available, and sequentially searching said plurality of frequencies to thereby determine a frequency capable of being received in a current area, said method comprising the steps of:

storing, for each of the plurality of frequencies, a number of times of synchronization set up at each preselected sampling time together with said sampling time; and determining, when a frequency search begins, a first and a second sampling time closest and second closest to a frequency search start time when said frequency search has begun, weighting numbers of times of synchronization respectively set up at said first sampling time and said second sampling time by weights inversely proportional to a difference between said search start time and said first sampling time and a difference between said search start time and said second sampling time, respectively, producing a sum of weighted numbers of times, and sequentially searching the plurality of frequencies in an order of a size of said sum, the frequency having the greatest sum being first.

6. A receipt frequency search control method for a radio selective calling receiver storing a plurality of frequencies each corresponding to a particular area in which a service is available, and sequentially searching said plurality of frequencies to thereby determine a frequency capable of being received in a current area, said method comprising the steps of:

storing, for each of the plurality of frequencies, a number of times of synchronization set up at each preselected sampling time together with said sampling time; and determining, when a frequency search begins, a first and a second sampling time closest and second closest to a search start time when said frequency search begins, producing a sum of numbers of times of synchronization respectively set up at said first sampling time and said second sampling time, and sequentially searching the plurality of frequencies in an order of a size of said sum, the frequency having the greatest sum being first.

* * * * *